US005514248A

United States Patent [19]

Okuda et al.

[11] Patent Number: 5,514,248

[45] **Date of Patent: * May 7, 1996**

[54] STACK TYPE EVAPORATOR

[75] Inventors: Nobuyuki Okuda; Masahiro Kojima, both of Oyamashi, Japan

[73] Assignee: Showa Aluminum Corporation, Osaka, Japan

[ * ] Notice: The portion of the term of this patent subsequent to Sep. 17, 2013, has been disclaimed.

[21] Appl. No.: 162,979

[22] Filed: Dec. 3, 1993

Related U.S. Application Data

[63] Continuation of Ser. No. 901,077, Jun. 19, 1992, abandoned, which is a continuation-in-part of Ser. No. 759,644, Sep. 12, 1991, Pat. No. 5,152,337, which is a continuation of Ser. No. 569,569, Aug. 20, 1990, abandoned.

[30] Foreign Application Priority Data

| | | | |
|---|---|---|---|
| Apr. 30, 1992 | [JP] | Japan | 4-082467 |
| May 22, 1992 | [JP] | Japan | 4-131153 |

[51] Int. Cl.[6] ..... B01D 1/00; F28F 13/18; F28D 9/00

[52] U.S. Cl. ..... 159/28.6; 62/515; 159/DIG. 21; 165/133; 165/153; 165/170; 165/913; 165/166

[58] Field of Search ..... 159/28.6, DIG. 21, 159/28.1; 165/153, 133, 170, 913, 166, 167; 106/14.15, 316; 62/288, 515; 202/267.1, 267.2

[56] References Cited

U.S. PATENT DOCUMENTS

| | | | |
|---|---|---|---|
| 3,664,888 | 5/1972 | Oga et al. | 159/DIG. 21 |
| 3,896,753 | 7/1975 | Shephard et al. | 106/197.1 |
| 4,011,905 | 3/1977 | Hillard | 165/153 |
| 4,371,034 | 2/1983 | Yamada et al. | 165/108 |
| 4,379,486 | 4/1983 | Kurihara | 165/153 |
| 4,712,612 | 12/1987 | Okamoto et al. | 165/145 |
| 4,723,601 | 2/1988 | Ohara et al. | 165/153 |
| 4,726,886 | 2/1988 | Kaneko et al. | 106/287.1 |
| 5,070,938 | 12/1991 | Mizuno et al. | 165/133 |
| 5,082,051 | 1/1992 | Ando | 165/153 |
| 5,125,456 | 6/1992 | Bertrand et al. | 165/153 |
| 5,152,337 | 10/1992 | Kawakatsu et al. | 165/153 |

FOREIGN PATENT DOCUMENTS

| | | |
|---|---|---|
| 271084 | 6/1988 | European Pat. Off. . |
| 0409130 | 1/1991 | European Pat. Off. . |
| 0415584 | 3/1991 | European Pat. Off. . |
| 3028304 | 2/1981 | Germany . |
| 3536325 | 5/1986 | Germany . |
| 566847 | 2/1981 | Japan . |
| 018629 | 1/1982 | Japan . |
| 60-45776 | 10/1985 | Japan . |
| 61-39589 | 9/1986 | Japan . |
| 63-33100 | 9/1988 | Japan . |
| 6461239 | 3/1989 | Japan . |
| 1299877 | 12/1989 | Japan . |
| 2277584 | 11/1990 | Japan . |
| 387595 | 3/1991 | Japan . |
| 349944 | 3/1991 | Japan . |

OTHER PUBLICATIONS

Automotive Industries, vol. 146, No. 2, dated Jun. 15, 1972.

*Primary Examiner*—Virginia Manoharan
*Attorney, Agent, or Firm*—Tilton, Fallon, Lungmus & Chestnut

[57] ABSTRACT

A stack type evaporator including tubular elements 1 each having a plurality of inwardly protruding recessed ribs 7 which extend from an upper header portion 1*a* of the element to a lower header portion 1*b*, with the ribs serving as straight drain canals 7*a*. A hydrophilic resin coating of a specific composition covers the outer surfaces of the tubular elements 1 and fins 2 each interposed between two adjacent tubular elements. The combination of straight drain canals with the specific hydrophilic resin coating is effective to facilitate the drainage of condensed water so that the water-drops are perfectly prevented from flying out of the evaporator, and that any stinking mold or mildew is not permitted to grow within a reduced amount of remaining adherent water. Also, the hydrophilic coating itself does not emit any unpleasant smell which has been inevitable to the prior art water glass coating, thus an air-conditioned environment always remains comfortable.

11 Claims, 13 Drawing Sheets

STACK TYPE EVAPORATOR

This application is a continuation of application Ser. No. 07/901,077 filed on Jun. 19, 1992 now abandoned, which was a continuation-in-part of application Ser. No. 07/759,644 filed Sep. 12, 1991, now U.S. Pat. No. 5,152,337 and which was a continuation of Ser. No. 07/569,569 filed Aug. 20, 1990, now abandoned.

BACKGROUND OF THE INVENTION

1. Field of the Invention

The present invention relates to an evaporator for use in a car air conditioner, and more particularly relates to a stack type evaporator which is improved not to cause the condensed waterdrop to fly and to be free from the problem of bad smell.

2. Description of the Prior Art

The stack type evaporators of this kind usually comprise plate-like tubular elements each composed of a pair of dish-like core plates 60 as shown in FIG. 11. These core plates face one another and are adjoined at their peripheries 60*a*. Such tubular elements are stacked side by side in the direction of thickness, with fin members each being interposed between the adjacent tubular elements. An inlet and outlet header portions 60*b* and 60*c* are formed at an end of each tubular element to form a coolant flow path. A coolant flowing through the inlet header portion 60*b* into the flow path in the tubular element will travel towards another end thereof, and makes one U-turn before coming back into the outlet header portion 60*c*. These tubular elements thus build the "one-sided header" stack type evaporator which are employed widely in this field. The "one-sided header" structure is somewhat disadvantageous in that due to the U-turn which the coolant makes, it cannot flow evenly through the tubular elements but flows in an offset manner. This will inevitably reduce the effective heat transfer area of each tubular element.

Therefore, another type of evaporator which is of the "both-sided header" structure has been proposed and used in certain cases. This evaporator comprises the tubular element each having the inlet header portion at its one end and the outlet header portion at its other end.

The prior art stack type evaporators, whether of the one-sided or both-side structure, employ such recessed ribs 70 which are distributed over each core plate 60 as shown in FIG. 11. Those ribs are intended to render turbulent the coolant stream within the tubular elements so as to improve the heat transfer. In detail, many recessed ribs 70 protrude inwardly of two dish-like core plates 60 which are secured one to another at their peripheries to construct each tubular element ( see for example Japanese Utility Model Publication Sho. 56-6847 and ibid. 63-33100 ).

However in use of those stack type evaporators, water which is condensed on the surfaces of the tubular elements and fin members will stay within the recessed ribs 70. An angle of contact ( hereinafter simply referred to as "contact angle" ) of each waterdrop and the surface of tubular element or fin member, to which the water drop sticks, is so large as making it difficult to smoothly drain the condensed water. As a result the condensed water staying within air paths, which are each formed between the tubular elements and through the fin member interposed therebetween, will be scattered to fly into an automobile compartment to thereby spoil the air-conditioned comfortableness thereof. Further, the air paths get mildewed due to the sticking condensed water, and a bad smell of mildew or mold will render unpleasant the air stream which may unintentionally flow into the compartment.

A prior art invention disclosed on the Japanese Patent Publication Sho. 60-45776 was made to resolve such a problem. According to this proposal, the tubular elements and fin members are covered with a hydrophilic surface coating. The hydrophilic coating reduces the contact angle between the surface of tubular element or fin member and the waterdrop. Consequently, the condensed water forms on the surfaces a thin layer which will decrease the air flow resistance along the surface, and the thin layer does not stay thereon but is drained smoothly to resolve the problem of flying waterdrop.

As described in the Patent Publication Sho. 60-45776, a water glass-based coating has been preferred as the hydrophilic coating. A smell inherent in this water glass coating itself is however not pleasant, and spoils the air-conditioned automobile cabin into which the outer air stream inevitably flows. Thus, such a prior art coating is not free from an essential problem.

Another Japanese Patent Publication Sho. 61-39589 or Patent Laying-open Gazette Hei. 3-49944 discloses, on the other hand, another proposal which employs a polyamide resin as the component of hydrophilic coating in place of the water glass. Although polyamide resin coating does not emit such a bad smell as water glass, it fails to cause the adherent water to form a sufficiently thin layer. Thus, the air flow resistance through the evaporator is comparatively high, the condensed water is difficult to drain, and the problem of waterdrop flying is not resolved.

On the other hand, it must be noted of a certain drawback caused by the recessed ribs. Even if the adherent state and flowability of condensed water were improved with the hydrophilic coating of the outer surface of the evaporator, the condensed water stays in the outer recesses of the ribs 70 which are formed separately in a scattered manner over the outer surface of each tubular element. Drainage of condensed water is not improved to a satisfactory degree, and the waterdrop flying and other secondary problems remain unresolved. Further, due to the staying condensed water, the tubular elements are likely to get mildewed. The mold or mildew will give off a bad smell into an automobile cabin and makes it unpleasant.

Therefore, the present applicant has proposed in its Japanese Patent Application Hei. 1-223685 ( see Patent Laying-open Gazette Hei. 3-87595 ), not to rely upon any hydrophilic coating, but to give the tubular elements a revised shape such that the drainage of condensed water is improved to prevent the waterdrop from flying and the bad smell is shut out.

According to this prior art structure of the evaporator, each tubular element is formed with a plurality of recessed ribs. Those ribs extend straight and in parallel with one another from an upper header portion to a lower header portion of said element. Because such ribs do function as drainage canals, the condensed water flows downwards to be discharged from the lower header portion. Thus, the condensed water sticking to the surface of tubular elements is removed smoothly through the recessed ribs, providing an improved property of "water repelling".

In the condenser of this type, corrugated fins are each interposed between two adjacent tubular elements and are so highly water-bearing that the condensed water cannot move readily from the fins onto the recessed ribs on tubular elements. Although the condensed water on the fins at their outer regions or outer ends adjoined to the tubular elements will readily move onto the latter and into their recessed ribs, the condensed water present deep in concaves of the corrugated fins will tend to stay there due to a strong surface tension. In other words, some fractions of the condensed water on the fins are not necessarily removed through the recessed ribs of the tubular elements.

As a result, the drainage of condensed water remains not improved to a satisfactory degree, also failing to resolve the problems of waterdrop flying and bad smell, which is emitted for example from the mold in the remaining and sticking water.

It may be natural to employ the hydrophilic coating composed of water glass or synthetic resin also for the tubular elements which are formed with the straight recessed ribs serving as the improved drainage canals.

However it will not be possible here too to avoid the already described problem that on one hand the water glass hydrophilc coating is unpreferable due to its stinking smell, and on the other hand the prior art resin coating cannot improve the adherent state and flowability of the condensed water. The condensed water will not move smoothly to such recessed ribs even though they are of the shape of straight drain canals, thus rendering the drainage unsatisfactory and failing to resolve the problem of waterdrop flying.

OBJECTS AND SUMMARY OF THE INVENTION

An object of the present invention, which has been made to resolve the problems inherent in the prior art evaporators, is therefore to provide a novel stack type evaporator which neither causes, the waterdrop flying, nor emits bad smell, so that it can be used advantageously in air-conditioning apparatuses.

The present inventors have carried out their research and studies to improve the stack type evaporator, which was already proposed by them to comprise tubular elements having vertical recessed ribs as summarized hereinbefore, in such a manner that the recessed ribs can function as more effective straight canals for draining the condensed water. As a result of such research, the inventors have found a fact that a hydrophilic resin coating on the surface of tubular elements must be formed of a particular resin composition such that the contact angle thereof falls within a specific range.

Thus, a stack type evaporator is provided herein which comprises tubular elements formed with a plurality of recessed ribs serving as straight drain canals and extending between an upper and lower header portions of each tubular element, in such a state that the condensed water is guided along the ribs towards the lower header portion so as to be discharged out of the tubular element. In addition to this feature, the evaporator in this invention further comprises a specific hydrophilic resin coating which is free from bad smell and covers both the surfaces of each fin and each tubular element, whereby the condensed water is readily transferred from the fin onto the tubular element and smoothly moves from a flat surface thereof into the outer recess of each rib.

In detail, the object of the present invention is achieved by a stack type evaporator which comprises: a plurality of plate-like tubular elements each composed of a pair of facing dish-like core plates which are adjoined one to another at their peripheries so as to define a coolant path therebetween; a plurality of radiating fins each interposed between the two adjacent tubular elements which are stacked side by side in the direction of their thickness; an upper and lower header portions respectively formed at an upper and lower ends of each tubular element, with the header portions being connected to the other corresponding header portions so as to unite the tubular elements to form the evaporator; a plurality of recessed ribs protruding inwardly from each core plate and extending vertically in parallel with one another from the upper header portion towards the lower header portion, wherein an inner end of each rib of one core plate faces and is bonded to a flat portion between the ribs of the other core plate, and wherein the coolant path formed through each tubular element is divided by the ribs into a plurality of discrete unit paths extending between the upper and lower header portions, each tubular element has on its outer surfaces a plurality of straight drainage grooves also extending between the upper and lower header portions, and a hydrophilic resin coating which covers the outer surfaces of each tubular element and each radiating fin is composed of a main component and a hydrophilic agent, with the main component being a polyvinyl alcohol resin, and the hydrophilic agent being a polyamide and/or polyvinyl pyrrolidone resins.

Alternatively, the object of the present invention may be achieved by a stack type evaporator which comprises: a plurality of plate-like tubular elements each composed of a pair of facing dish-like core plates which are adjoined one to another at their peripheries so as to define a coolant path therebetween; a plurality of radiating fins each interposed between the two adjacent tubular elements which are stacked side by side in the direction of their thickness; an upper and lower header portions respectively formed at an upper and lower ends of each tubular element, with the header portions being connected to the other corresponding header portions so as to unite the tubular elements to form the evaporator; a plurality of recessed ribs protruding inwardly from each core plate and extending vertically in parallel with one another from the upper header portion towards the lower header portion, wherein an inner end of each rib of one core plate faces and is bonded to a flat portion between the ribs of the other core plate, and wherein the coolant path formed through each tubular element is divided by the ribs into a plurality of discrete unit paths extending between the upper and lower header portions, each tubular element has on its outer surfaces a plurality of straight drainage grooves also extending between the upper and lower header portions, and a hydrophilic resin coating which covers the outer surfaces of each tubular element and each radiating fin, with the resin coating having a contact angle $\theta$ falling within a range of about 5° to 20°.

In addition to polyvinyl alcohol resin as the main component blended with the hydrophilic agent, the resin coating may preferably contain further ingredients including a film hardener, a surface active agent ( hereinafter referred to as "surfactant" ), and a microbicide such as an antibacterial agent, a bactericide or a mold-suppressing agent which inhibit any bad smelling mold or mildew to grow on the surfaces of evaporator.

A desirable recipe of such a resin coating includes: 30–65 parts by weight of polyvinyl alcohol resin as the main component; 20–65 parts by weight of polyamide and/or polyvinyl pyrrolidone resins as the hydrophilic agent; 1–15 parts by weight of the film hardener; 0.1–2.0 parts by weight of the surfactant; and 3–30 parts by weight of the microbicide.

Although either polyamide alone or polyvinyl pyrrolidone resin alone suffices as the hydrophilic agent, a mixed solution of them is more desirable.

The film hardener may either be a phenolic resin or a polyurea resin, though the former is less stinking and therefore more preferable.

A preferable surfactant is a nonionic surface active agent.

The appropriate microbicides include: bis-(2-pyridylthio)-zinc 1,1'-diphoxide; methyl benzimidazole carbamate; and 2-(4-thiazolyl)-1H-benzimidazole.

The contact angle θ of the hydrophilic resin coating is an important factor in the present invention. An angle less than 5° causes the condensed water to be excessively adherent to the surfaces of tubular elements and fins, whereas a greater angle above 20° undesirably renders the condensed water to be unadherent but less mobile with regard to the straight drain canals. In these cases, the straight canals will fail to fully function as the drainage canals. Therefore, the contact angle θ should be 5°–20°, and more desirably 7° to 13°.

The inwardly protruding recessed ribs provide the straight drain canals which must, for better drainage, be designed such that their canal width "W", canal depth "D" and canal pitch "P" are included respectively in ranges given below. Also, an area ratio (%) of the canals to an entire surface area of each core plate, from which the area of expanded portions located on both sides of said core plate is subtracted, should fall within a range given below.

The canal width "W" is from 1–3 mm, or more preferably 1.3–2.4 mm.

The canal depth "D" is from 1–2.5 mm, or more preferably 1.5–2.1 mm.

The canal pitch "P" is from 7–14 mm, or more preferably 8–11 mm.

The area ratio (%) of the canals is 5–40%, or more preferably 15–25%.

It will be understood that the recessed ribs protruding inwardly of each tubular element and extending from its upper header portion to lower header portion are advantageous in that any amount of condensed water on the tubular elements and fin members smoothly flows along the ribs towards outside. Then, the condensed water will quickly leave the evaporator, without causing any problem of waterdrop flying.

The hydrophilic resin coating, which covers the outer surfaces of the tubular elements and fin members and comprises polyvinyl alcohol resin as main component as well as polyamide and/or polyvinyl pyrrolidone resins as the hydrophilic agent, does not emit any bad smell which has been unavoidable in the water glass coating. Besides, the resin coating of the specific composition in the present invention advantageously cooperates with the inwardly protruding recessed ribs, i.e., the straight drain canals, to enhance a water-repelling property to facilitate the drainage of condensed water. Thus, the problem of waterdrop flying is more completely avoided in the evaporator provided by the invention.

BRIEF DESCRIPTION OF THE DRAWINGS

The present invention will become more apparent from embodiments described referring to the accompanying drawings: in which.

DETAILED DESCRIPTION OF THE PREFERRED EMBODIMENTS

Embodiments of the invention which are applied to a stack type evaporator made of aluminum or its alloys for use in a car air-conditioner will now be described in detail.

Figure 7:
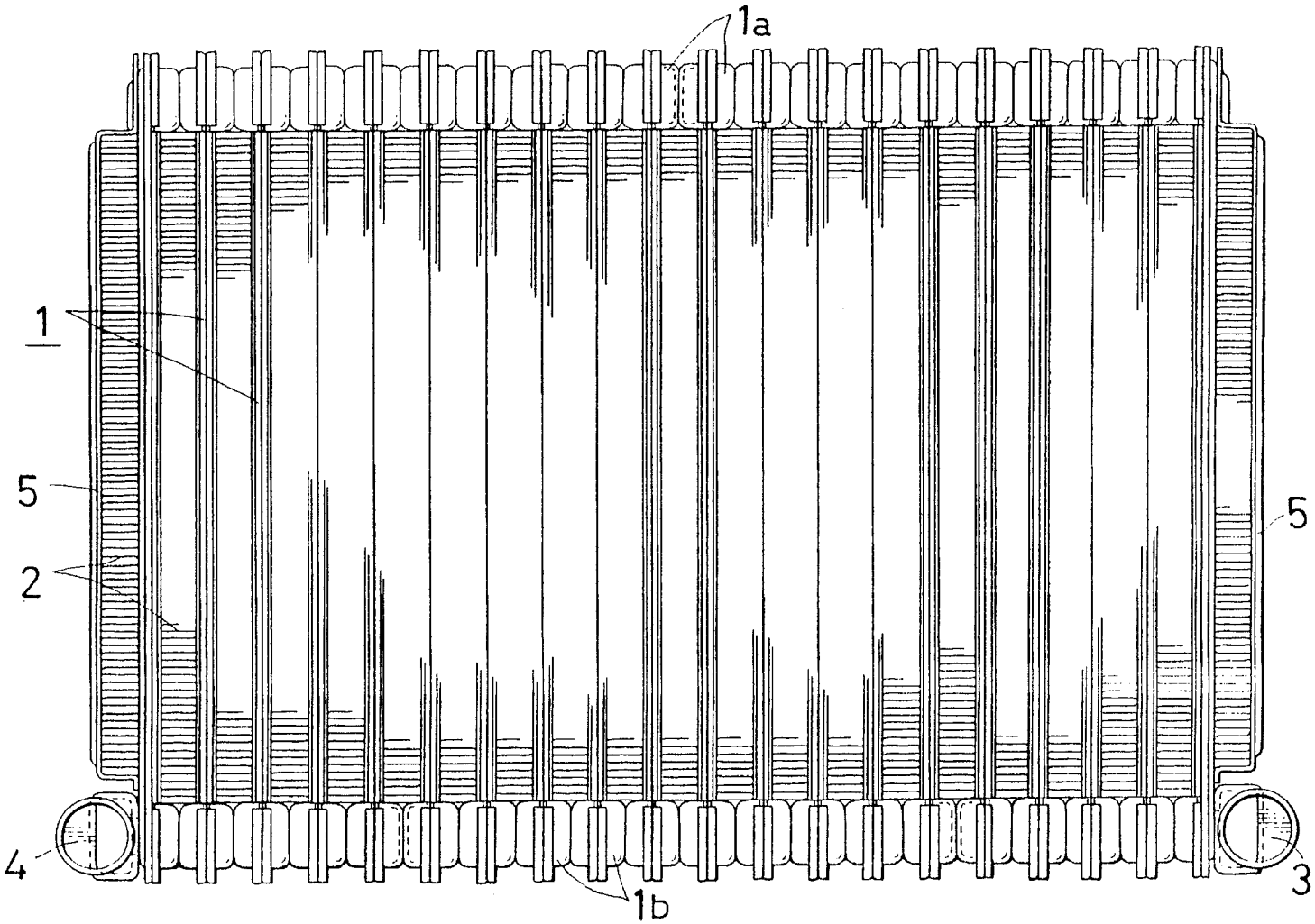
FIG. 7 is a front elevation showing the evaporator in its entirety.

As shown in FIG. 7 in its entirety, the evaporator comprises a plurality of plate-like tubular elements 1 which are disposed upright and stacked side by side. The evaporator also comprises corrugated fin members 2, most of which are interposed between two adjacent tubular elements 1, with the other ones being disposed outside the outer-most tubular elements 1. The corrugated fin members 2 are brazed to the tubular elements so as to be integral therewith.

Each tubular element 1 is, as shown in FIGS. 1 to 7, provided with an upper and lower header portions 1*a* and 1*b* which are bulky and disposed respectively at opposite ends in a longitudinal direction of the element. Unit coolant paths 1*c* extending longitudinally of the element 1 are formed intermediate between and in fluid communication with the header portions 1*a* and 1*b*, the unit coolant paths 1*c* constituting as a whole a flat coolant path. The adjacent tubular elements 1 are tightly combined one with another at their header portions 1*a* and 1*b*, which portions are connected in fluid communication with each other through coolant-flowing openings 1*d*.

Each tubular element 1 is made by arranging two dish-like core plates 6 into an inside-to-inside relation and by subsequently brazing them at their peripheries 6*a* to be integral with each other. The core plates 6 are manufactured by the pressing of a brazing sheet which comprises a core sheet having its front and back surfaces covered with a brazing agent layer. The brazing agent layer is applied by the cladding technique so that the core plates 6 are easily brazed together and also brazed to the adjacent corrugated fins 2.

Figure 6:
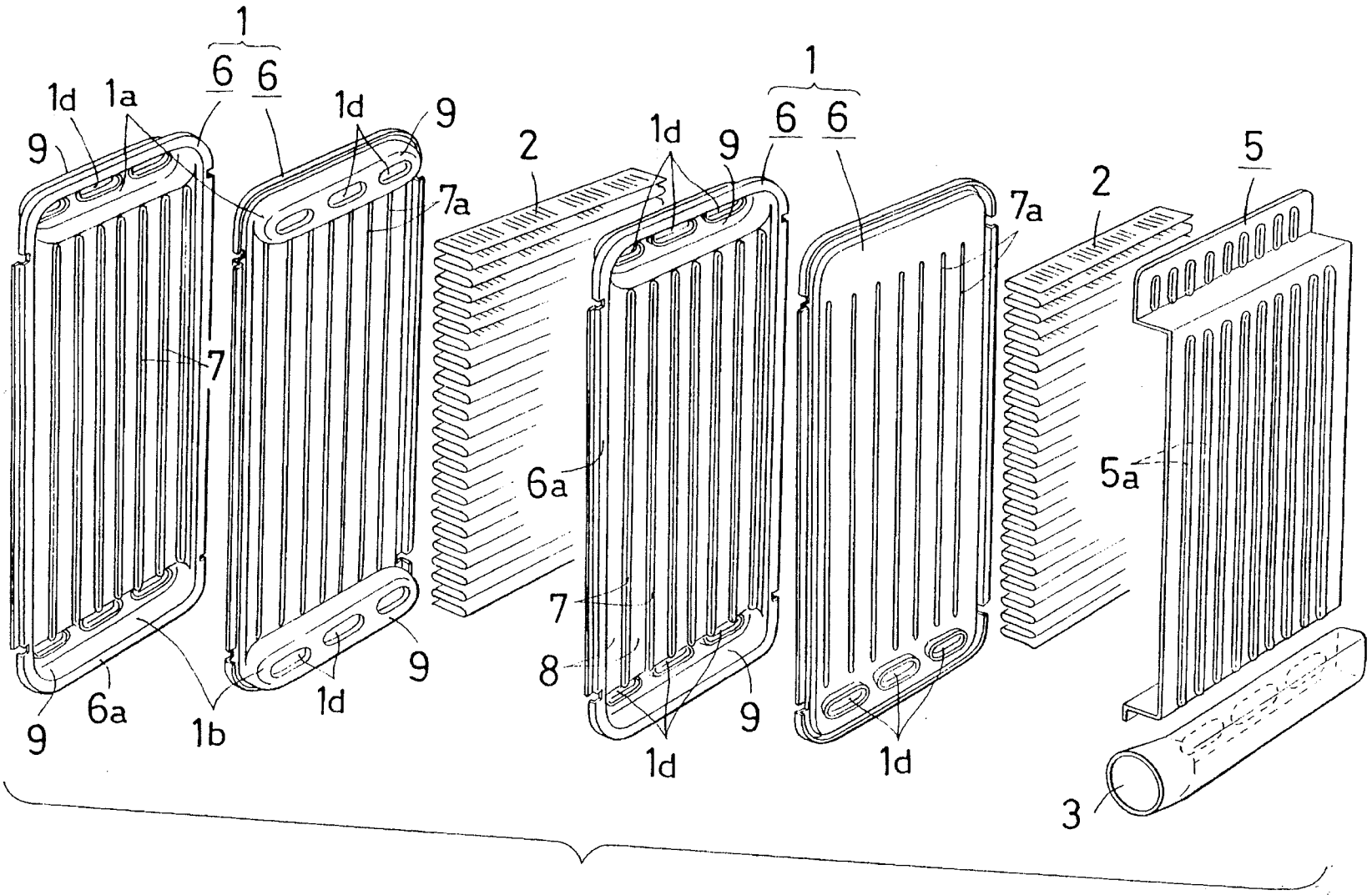
FIG. 6 is a perspective view showing a section of the evaporator, in its state separated from remaining portions thereof.

End portions of each core plate 6, except for outer core plates 6 constituting the outermost tubular elements 1, respectively protrude outwardly to provide expanded portions 9. Each outer core plate 6 has, as shown in FIG. 6, both ends formed flat and comprising three coolant-flowing openings 1*d* arranged in a transverse direction.

Three other coolant-flowing openings 1*d* pierce a ridge of each expanded portion transversely of the core plate, so that the header portions of adjacent tubular elements 1 communicate with each other. However, as shown in FIG. 7 illustrating an entirety of this evaporator, there are no such openings 1*d* through the contacting side walls of expanded portions 9 which belong to the lower header portions 1*b* of the fifth and sixth tubular elements 1, counted from the right end. Also, there are not provided such openings 1*d* through contacting side walls of expanded portions belonging to the upper header portions 1*a* of the tenth and eleventh tubular elements 1. Similarly, there are no such openings 1*d* through the contacting side walls of expanded portions 9 which belong to the lower header portions 1*b* of the fifteenth and sixteenth tubular elements 1. Those side walls of expanded portions which are not pierced by any openings do function as partitions disposed between the adjacent expanded portions.

As shown in FIG. 7, each corrugated fin 2 is interposed between the adjacent tubular elements 1, which are brazed together in this state due to the brazing agent layer mentioned above. A coolant inlet pipe 3 is connected to the lower header portion 1*b* of right-hand outermost tubular element 1, in fluid communication therewith. A coolant outlet pipe 4 is connected likewise to the lower header portion 1*b* of left-hand outermost tubular element 1, also in fluid communication therewith.

Figure 8:
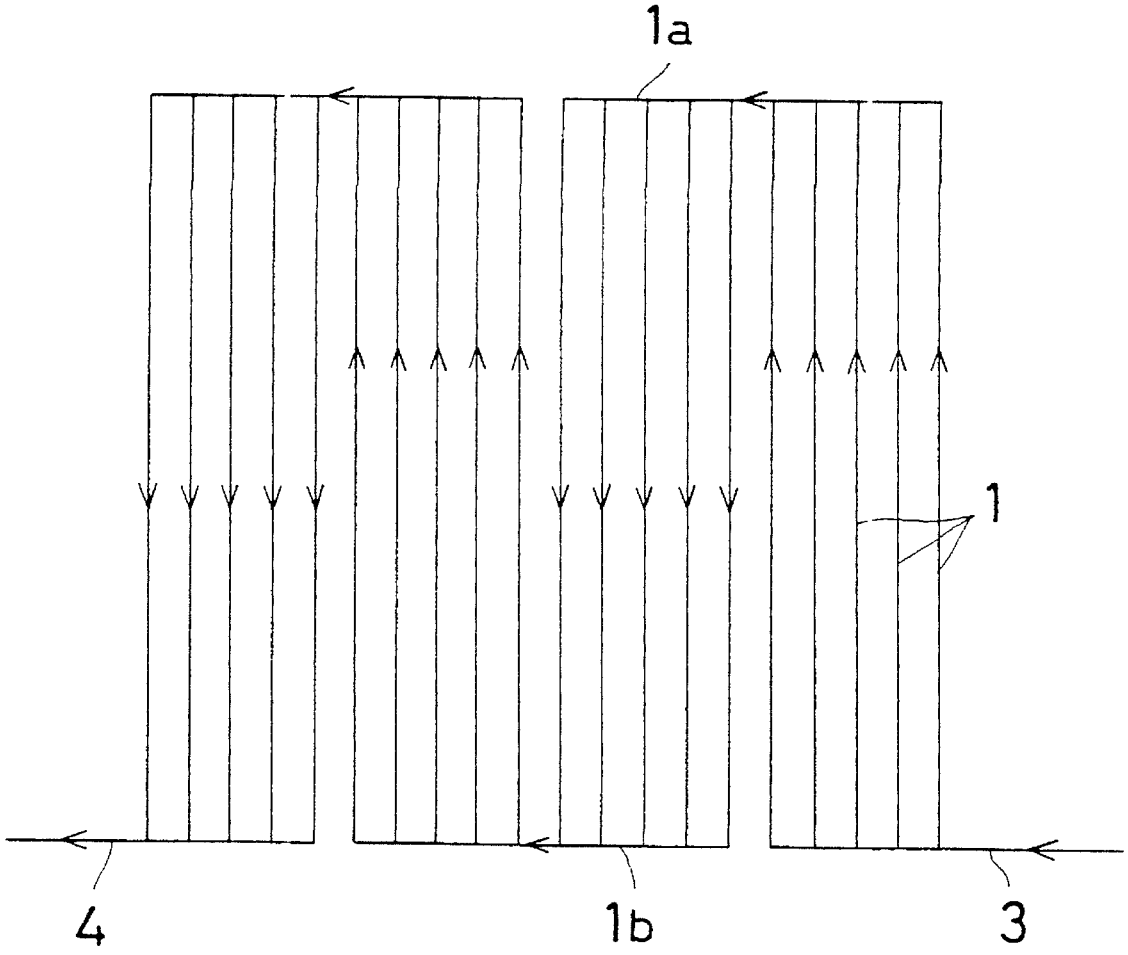
FIG. 8 illustrates a coolant flow.
Figure 9:
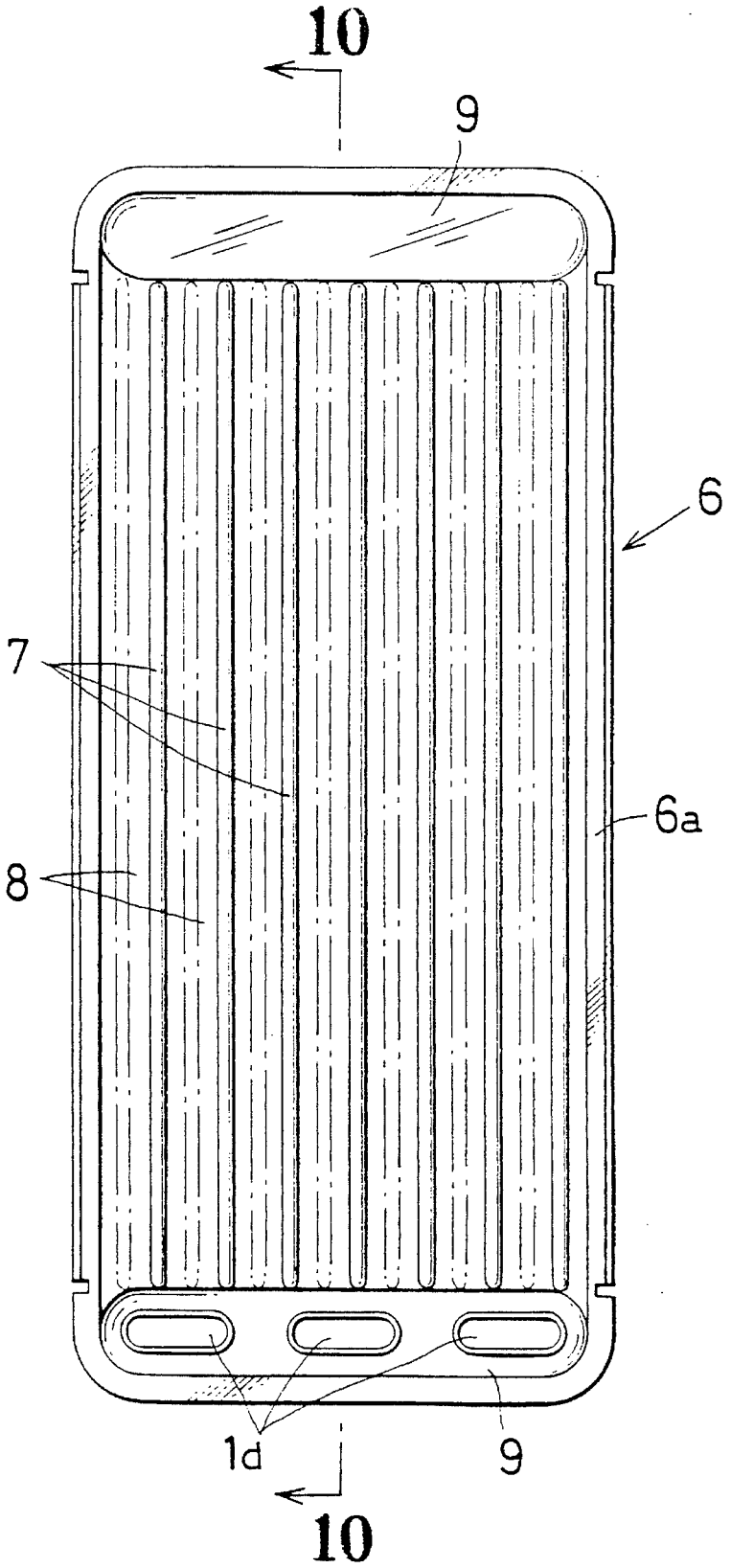
FIG. 9 is a plan view of a core plate which forms a partition disposed in the header portion.
Figure 10:
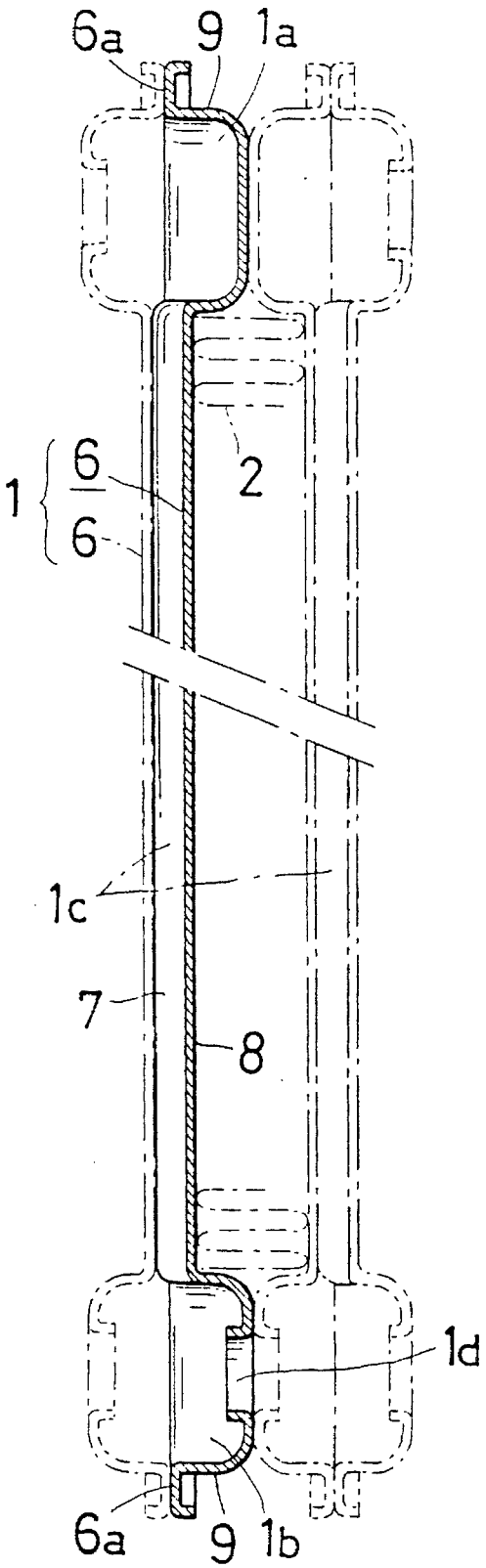
FIG. 10 is an enlarged cross section taken along the line 10—10 in FIG. 9.
Figure 11:
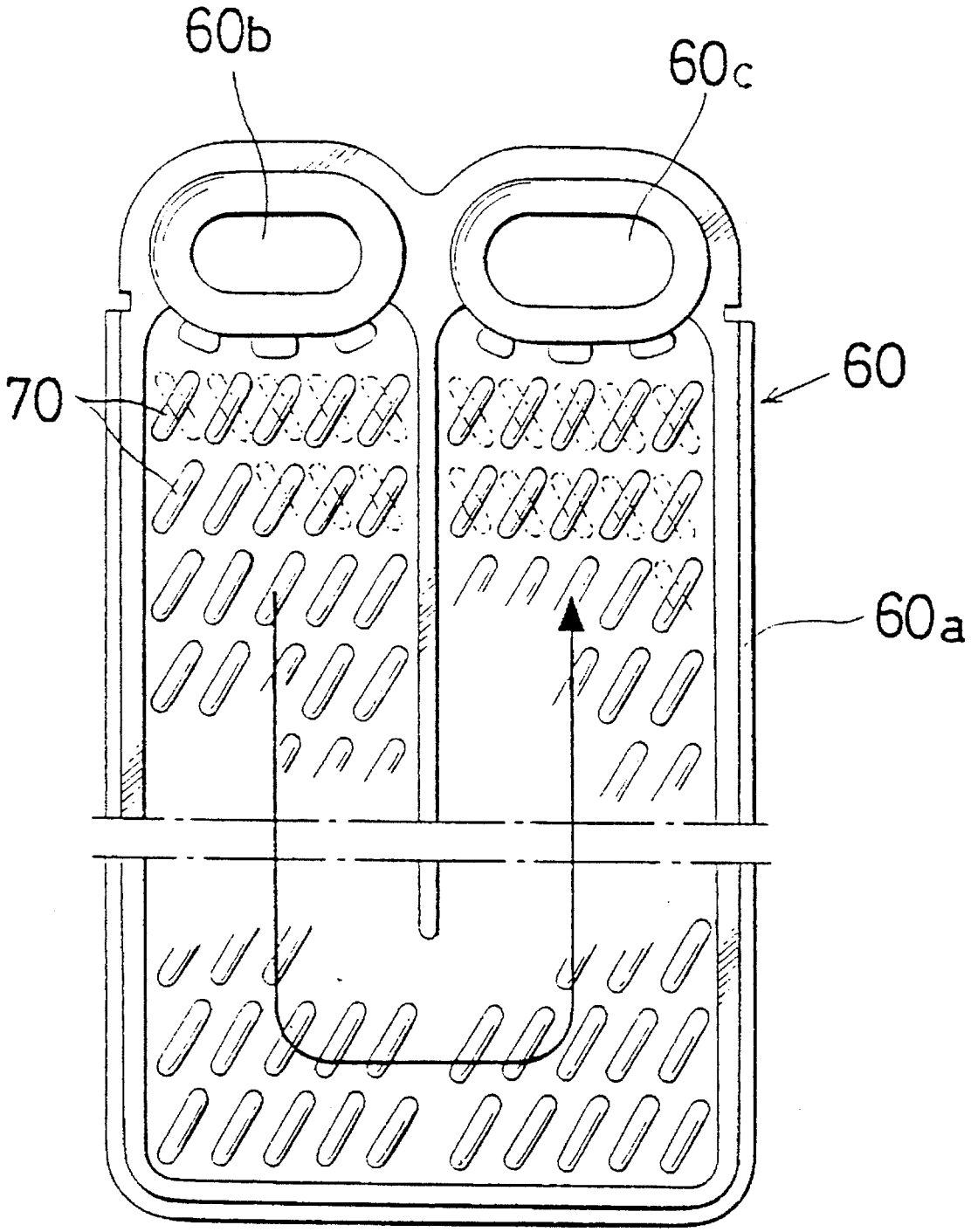
FIG. 11 PRIOR ART
FIG. 11 is a plan view of the prior art core plate, seen from the side of a unit coolant path formed therein.

Due to the partitions mentioned above, the coolant entering the evaporator through the inlet pipe 3 is caused to advance in a zigzag pattern, as shown in FIG. 8, changing its flow direction at every boundary between adjacent groups of the tubular elements, before the coolant leaves the evaporator through the outlet pipe 4. Thus, heat exchange is effected between the coolant flowing in this way and air streams passing through air paths, each air path being formed in a gap between the adjacent tubular elements and including the intervening fin member 2. The reference numeral 5 in FIGS. 6 and 7 denotes a side plate disposed outside the outermost corrugated fin member.

The "groups" in this embodiment comprise the same number of the tubular elements 1, whereby an excellent property of heat exchange is enhanced to the evaporator. However, the total number of the tubular elements may occasionally make it impossible to divide them into the groups of even number of constituent tubular elements. In a case wherein the inlet and outlet pipes 3 and 4 are connected to the lower portions of the outermost tubular elements, despite the uneven numbers of said elements in the groups, it is desirable to constitute one of the groups connected to the inlet with a larger number of said elements than the other groups. There may be another case in which it is desirable to increase the number of tubular elements progressively from the group for the inlet towards the other group for the outlet. Details will be decided in such a case to gradually increase the substantial cross-sectional area of the coolant path towards the outlet, taking into account the total number of said elements, the number of U-turns made by coolant, the positions where the inlet pipe 3 and outlet pipe 4 are connected to the evaporator body, or other conditions. In other words, the most desirable grouping of the tubular elements should be employed in consideration of all the relevant conditions.

Figure 1:
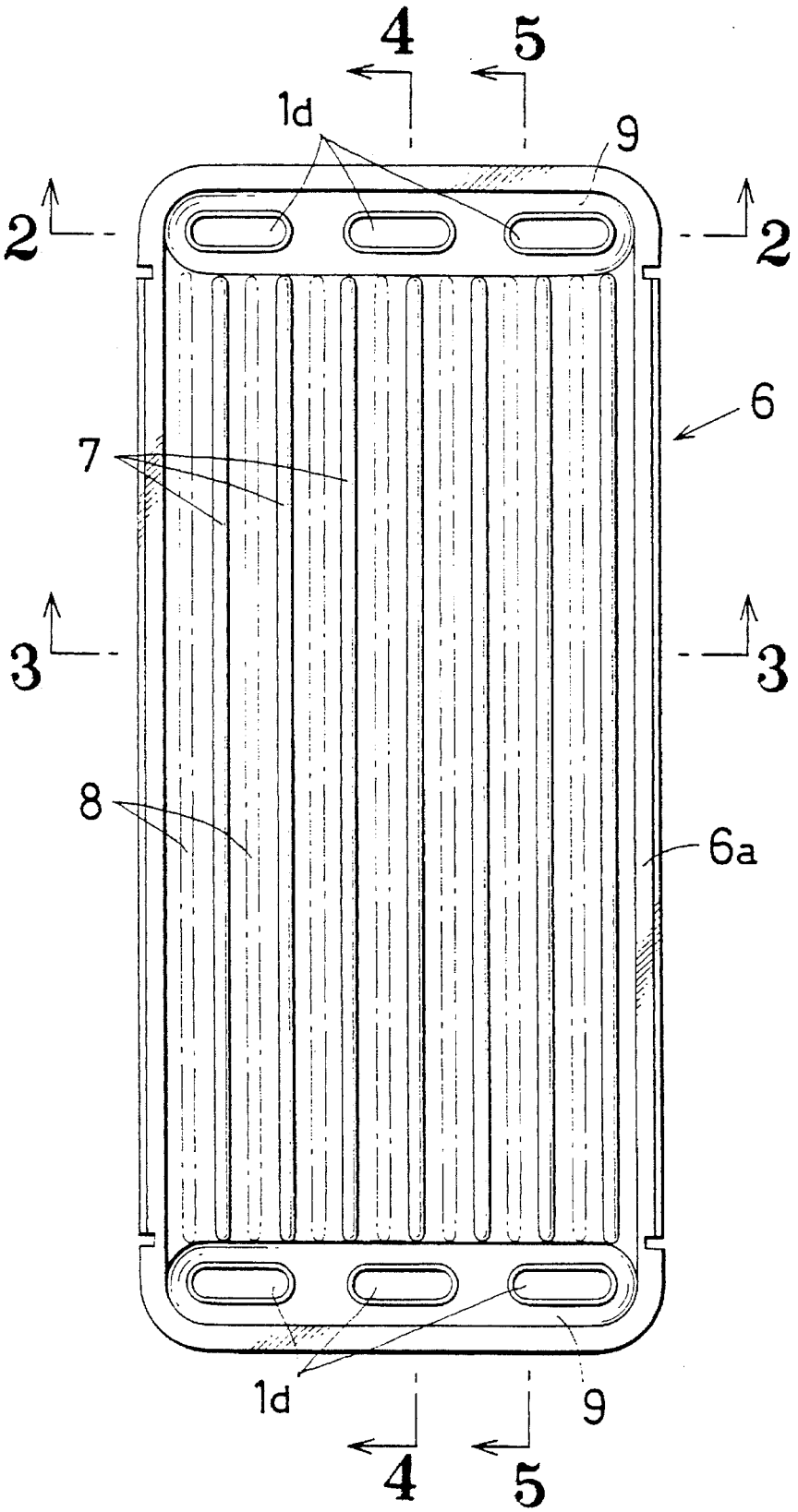
FIG. 1 is a plan view of a core plate constituting an evaporator in an embodiment, seen from the side of unit coolant paths.
Figure 2:
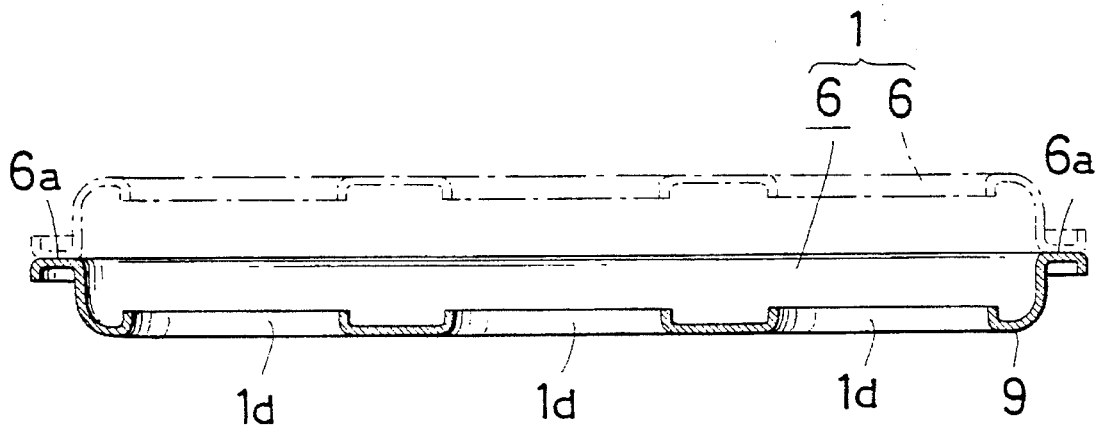
FIG. 2 is an enlarged cross-sectional view taken along the line 2—2 in FIG. 1.
Figure 3:
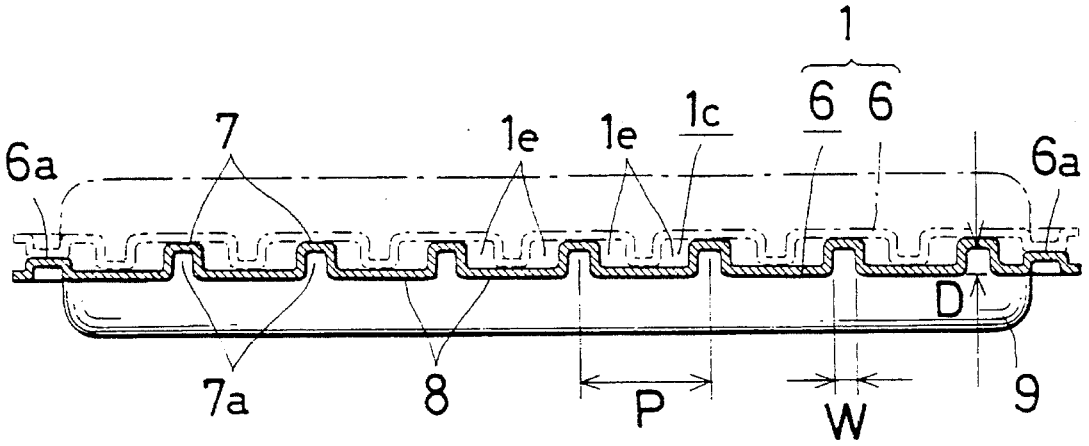
FIG. 3 is another enlarged cross-sectional view taken along the line 3—3 in FIG. 1.
Figure 4A:
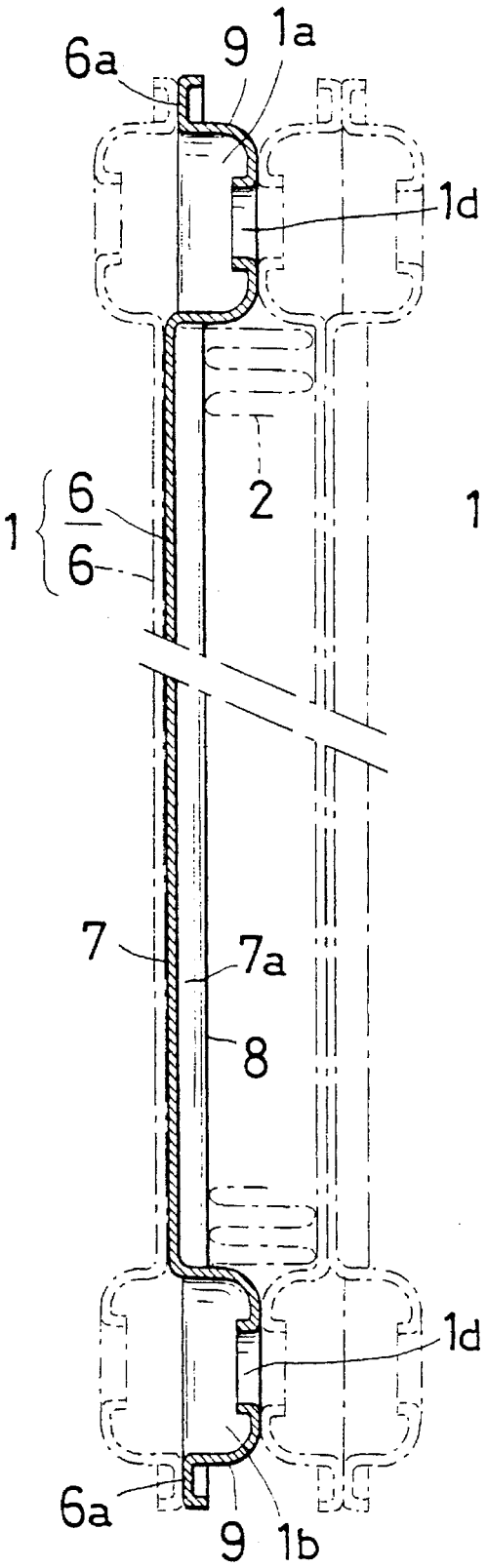
FIG. 4A is a further enlarged cross-sectional view taken along the line 4—4 in FIG. 1.
Figure 4B:
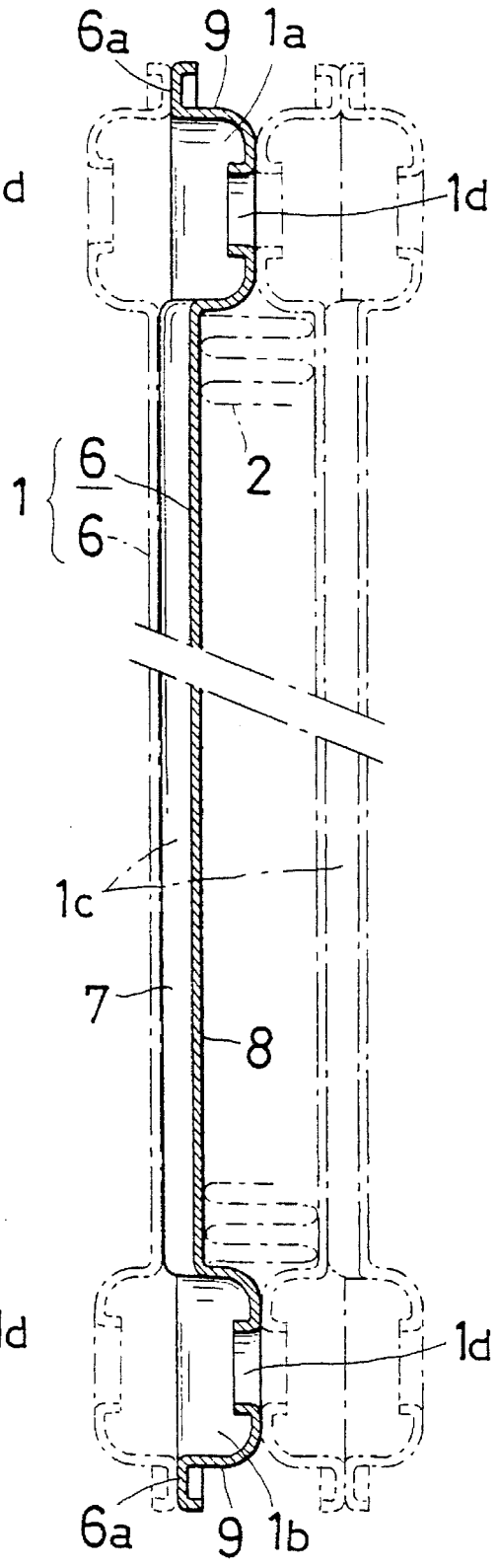
FIG. 4B is a still further enlarged cross-sectional view taken along the line 5—5 in FIG. 1.

As shown in FIGS. 1, 3 and 6, recessed ribs 7 are formed on an inner surface of each core plate 6, between its two expanded portions 9, and at regular intervals transversely of the core plate. The positions of recessed ribs are however offset transversely towards one of longitudinal sides of said core plate. The inwardly protruding recessed ribs 7 which extend straight from one expanded portion 9 to the other one will function as straight drain canals, as will be detailed later. A couple of two core plates 6 having the ribs 7 are brought into close contact and are brazed at their peripheries 6*a* integral with one another. As seen in FIGS. 1 and 3, the ribs 7 of one core plate 6 shown by rigid lines and those of the other core plate shown by phantom lines alternate with each other. Inner end surfaces of the ribs 7 of one core plate 6 tightly engage with and are brazed to flat portions 8 between two adjacent ribs 7 of the other core plate, whereby a plurality of unit coolant paths 1*e* are defined straight from the delivery header portion 1*b* to the return header portion 1*a* within the coolant flow path 1*c* of each tubular element 1. Thus, straight drain canals 7*a* are defined by the inwardly protruding recessed ribs 7. For the purpose of improving the drainage of condensed water and in view of other requirements, it is desirable to select within the following ranges the parameters or dimensions of said drainage canals, such as their width "W", depth "D" and pitch "P" as shown in FIG. 3, as well as area ratio (%) of said canals to the core plate's 6 surface area from which the expanded portions 9 are excluded.

The canal width preferably falls within a range from 1 to 3 mm. If the canals are narrower than 1 mm, then the condensed water cannot flow smooth into them, thus the straight canals failing to effectively function as drainage grooves. With the canals being set broader than 3 mm, the coolant unit flow paths 1*e* are too narrow to maintain the pressure loss of coolant below a certain limit. The most desirable range of said width is thus from 1.3–2.4 mm.

The canal depth preferably falls within a range from 1 to 2.5 mm. If the canals are made shallower than 1 mm, then the unit flow paths 1*e* become too small to keep the coolant pressure loss below the certain limit, and the condensed water cannot flow at a sufficient rate through them, thus the straight canals failing to function as drainage grooves. With the canals being set deeper than 3 mm, the hydraulic diameter of the unit flow paths becomes too large to ensure an excellent property of heat exchange. The most desirable range of said depth is thus from 1.5–2.1 mm.

A preferable range of the canal pitch is from 7 to 14 mm. If the pitch is smaller than 7 mm, then the unit flow paths 1*e* become too small to keep the coolant pressure loss below the certain limit. With the canal pitch greater than 14 mm, the condensed water cannot flow smooth into canals. The most desirable pitch is thus from 8–11 mm.

Figure 12:
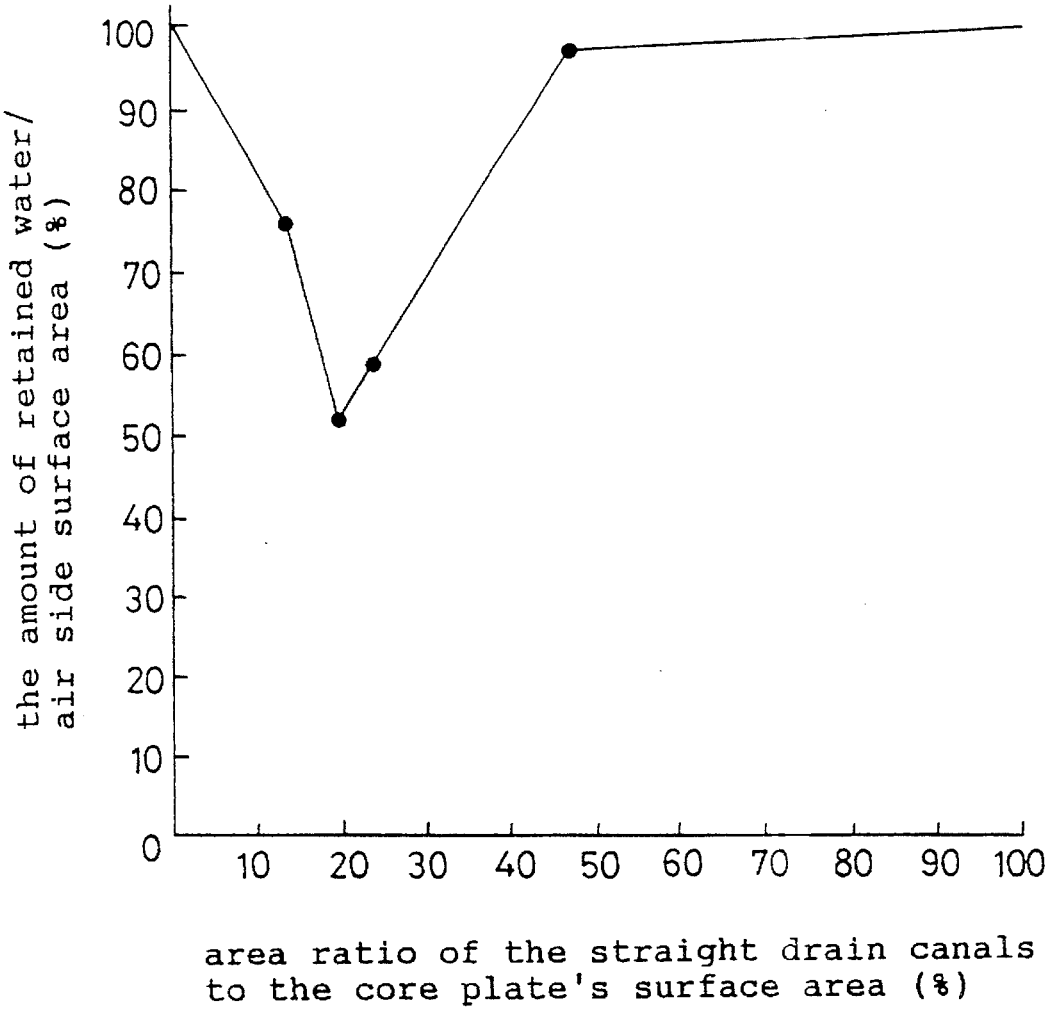
FIG. 12 is a graph showing a relationship between an "area" ratio (%) and an "amount" ratio (%) of water retained on the core plate 6 wherein the "area" ratio is a ratio of area of straight drain canals to an entire surface area of the core plate, from which both side expanded portions are subtracted; and the "amount" ratio is a ratio of the retained water amount to an outer surface area of the core plate in contact with air, and is given in % by taking as a standard ( i.e., 100 ) a value for a case in which no canals are formed on the core plate.

The area ratio (%) of the straight drain canals to the core plate's 6 surface area except for the expanded portions 9 should fall within a range of 5–40%. If the ratio is not included in this range, then the straight canals are no longer good grooves for drainage, because an excessive amount of condensed water is retained by the core plate. FIG. 12 shows a graph representing such an condition, in which the area ratio (%) of straight canal area to the amount of retained water for a unit surface in contact with air is given taking as a reference value ( i.e., 100% ) for a case wherein no canals are formed on the core plate. In addition to failing to serve as the straight grooves for drainage, the drain canals having the area ratio above 40%, the flow path 1*c* becomes too narrow to maintain the pressure loss of coolant below a permissible limit. Thus, the most desirable ratio is from 15–25%. The amount of retained water in the graph means an amount of water retained by tested evaporators which are immersed in a water vessel and weighed 30 minutes after withdrawal therefrom.

The cross-section of the inwardly protruding recessed ribs 7 need not necessarily be of such a rectangular shape as shown in FIG. 3, but may be of a trapezoid shape having a width gradually reduced towards its inner bottom, or any other shape. However, the illustrated shape in this embodiment is desirable for ensuring the good drainage function of the straight canals.

Figure 5:
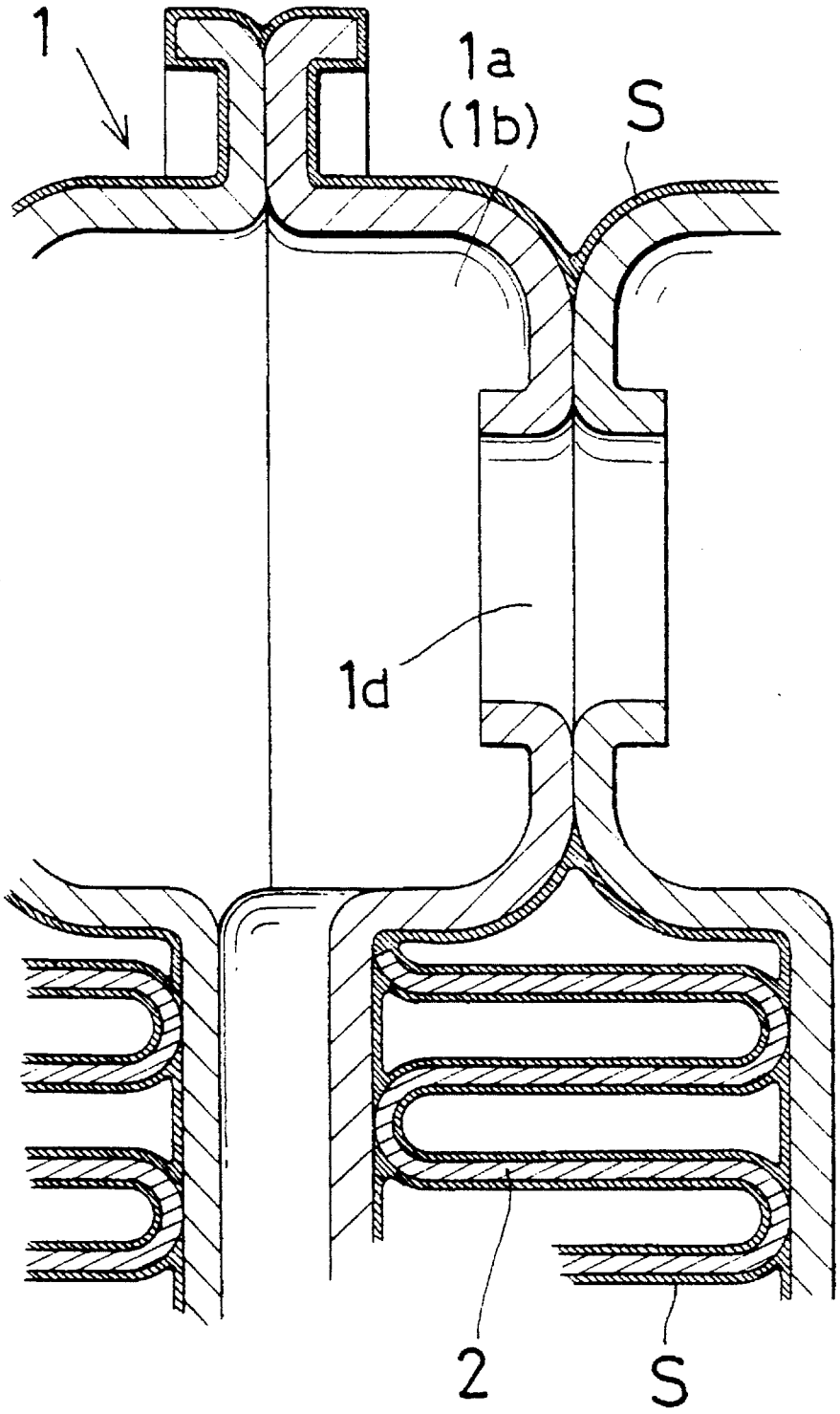
FIG. 5 is an enlarged cross-sectional view of a tubular element's portion including and adjacent to a header portion.

The side plates 5, which are disposed outside the outermost corrugated fins 2, comprise a plurality of groove-like recesses 5*a* formed on their inner surfaces. The recesses 5*a* extend vertically in parallel with one another so as to provide another plurality of additional vertical drainage canals between the outermost fins and the side plates secured to the outer surface thereof. Therefore, the water condensed in the clearances between the outermost tubular elements and the side plates flows downwards through the additional canals, whereby drainage is improved also for those air paths defined through said clearances. In this embodiment, a coating "S" composed of a hydrophilic resin covers the surfaces of the tubular elements 1, the corrugated fins 2 and the side plates 5, as illustrated in FIG. 5.

The hydrophilic resin must comprise a polyvinyl alcohol which is contained as a main component and is blended with a polyamide and/or polyvinyl pyrrolidone resins, for the following reasons. Firstly, this resin composition is free from an unpleasant smell which the prior art water glass resin coating itself has been emitting to impair the environment within an automobile cabin or room. In other words, the air-conditioned room of automobile can be maintained pleasant if the resin coating provided in the present invention is used as the coating of the evaporator. Secondly, the resin coating of such a composition can also prevents an underlying oxide layer from emitting its odor. Thus, the problem of the smelling evaporator is resolved more completely. Thirdly, such a resin coating as provided together with the straight drain canals in the present invention is advantageous in that the canals can function more effectively as the grooves for drainage. In more detail, the condensed water is excessively adherent to the water glass coating to such a degree that the straight drain canals cannot fully perform their draining function. The prior art resin coating, on the other hand, causes the condensed water less adherent but less mobile so that the straight drain canals are hindered from performing their function, also failing to prevent the problem of waterdrop flying. The novel resin coating in the present invention is of a nature intermediate the water glass coating and the prior art resin coating, whereby the straight drain canals can perform their draining function to a satisfactory degree.

The polyvinyl alcohol resin as the main component of said hydrophilic resin may either be blended with polyamide resin, or with a polyvinyl pyrrolidone resin. However, it is more desirable that both of the polyamide and polyvinyl pyrrolidone resins are added to the polyvinyl alcohol resin in order that the resin coating has a better initial hydrophilic property as well as a better durability thereof.

In addition to the polyamide and/or polyvinyl pyrrolidone resins as the hydrophilic agent which are blended with the polyvinyl alcohol resin as the main component to thereby form a mixture, further a film hardener such as a phenolic resin or polyurea resin, and a surfactant such as a nonionic surface active agent, as well as a microbicide for example: bis-(2-pyridylthio)-zinc 1,1'-diphoxide; methyl benzimidazole carbamate; or 2-(4-thiazolyl)-1H-benzimidazole may be blended with the mixture.

The phenolic resin as the film hardener is less stinking, and therefore better than polyurea resin.

The preferable contents of the polyvinyl alcohol resin, hydrophilic agent, film hardener, surfactant and microbicide are respectively 30–65 parts, 20–65 parts, 1–15 parts, 0.1–2.0 parts, and 3–30 parts, all by weight. The reasons therefor are as follows.

If the content of polyvinyl alcohol resin, which is contained as the main component to be a base material of the hydrophilic resin coating, is below 30 parts by weight, then the coating will not be hydrophilic to a sufficient degree and also will be too thin to have the microbicide dispersed therein. A higher content thereof above 65 parts by weight however raises the manufacture cost of the hydrophilic coating, and at the same time impairs its hydrophilic property. A more desirable content of the polyvinyl alcohol resin is therefore 40–60 parts by weight.

If the content of hydrophilic agent, which is added to improve the hydrophilic property of the resin coating, is below 20 parts by weight, then the coating cannot be hydrophilic to a sufficient degree. A content exceeding 65 parts by weight of said hydrophilic agent causes a superfluous solubility of the resin coating. In a case wherein the microbicide is contained, it will be lost when the coating is dissolved, thus failing to prevent growth of the mold or mildew. A more desirable content of said hydrophilic agent is 35–45 parts by weight.

If the film hardener, which adjusts a hardness of the coating to a desirable level, is contained at a poor content below 1 part by weight that will produce an unhardened coating, whereas a rich content above 15 parts by weight will cause its reaction with the hydrophilic atom groups in the hydrophilic resin molecules, consequently failing to enhance the hydrophilic property. A more desirable content of the film hardener is thus 5–10 parts by weight.

The surfactant is added to stabilize the resin solution, in which the evaporator or its part are immersed to form the hydrophilic coating, so that it will not become bubbly when used. Therefore, its content below 0.1 parts by weight is too poor to prevent the solution from bubbling. Such a poor content is also insufficient to disperse the microbicide homogeneously in the resin coating, but an excessive content above 2.0 parts by weight will also produce many bubbles in resin solution, resulting in an unevenness of the hardened resin coating. A more desirable content of the surfactant is therefore 0.5–1.5 parts by weight.

The microbicide includes in this specification an antibacterial agent, bactericide, mold-suppressing agent or the like. The hydrophilic resin containing such a microbicide protects the evaporator from getting mildewed in spite of the existence of adherent condensed water, lest the mold or mildew should emit a stinking odor. The surfactant mentioned above is effective also to disperse such a microbicide within the resin solution.

Three to thirty parts by weight of the microbicide may be added to said resin. Although a poor content below 3 parts by weight is not effective to perfectly prevent the breeding of mildew, an excessive content above 30 parts by weight will produce a white powder of the microbicide on the surface of evaporator. Such a powder is likely to fly and enter the air-conditioned automobile room, thus impairing its comfortableness. Therefore, a more desirable content is 5–15 parts by weight.

The thickness of the abovedescribed hydrophilic resin coating "S" is preferably from 0.2–1.5 μm. A resin coating thinner than 0.2 μm cannot perform the functions needed to the hydrophilic coating, but with a thickness more than 1.5 μm an inherent odor of the resin itself becomes conspicuous. A more desirable range of the thickness is from 0.5–1.3 μm.

As is summarized hereinbefore, the inventors have found the fact that in relation to the straight drain canals 7*a* the hydrophilic resin coating needs to have a contact angle θ 5° to 20° in order that those canals can fully function as the grooves for drainage.

According to the previous concept before this invention was made, the contact angle must be as small as possible. However, the present inventors have revealed a fact that the contact angle below 5° renders the condensed water excessively adherent to the evaporator surfaces and thus impairs the inherent high drainage capacity possessed by the straight canals 7*a*. A greater contact angle above 20° on the other hand has also proved inappropriate, since a poor adhesion of the condensed water was observed to similarly impair the drainage of straight canals 7*a*. Thus, a desirable range of the contact angle is from 5° to 20°, and more preferably from 7° to 13°.

The hydrophilic resin coating "S" may be formed for example in the following manner.

After assembled to have the described structure, the stack type evaporator will be subjected to a pretreatment, an acid washing process and a rinsing process, in this order and under usual conditions. Then, a chromate primer is formed on the thus prepared surface, by an appropriate process using a mixed solution of phosphate and chromate compounds or using a solution of an appropriate chromate compound. This primer will enhance the surface by giving it a higher corrosion resistance and enable the resin to closely adhere to the surface.

Subsequent to those treatments, the stack type evaporator will be washed to be successively submerged in a hydrophilic resin solution of such a recipe as described above. An unhardened resin coating is formed on the surface in this way, and finally, the evaporator is subjected to a baking process to harden and finish the coating.

A surprising effect provided by the invention was confirmed in the following tests. At first, six samples of the stack type evaporators were prepared which were basically the same as those described above in the embodiment. Those samples were either of the one-sided header type or both-sided header type, and comprised different kinds of the recesses on their tubular elements, and different kinds of, or no hydrophilic coatings, as shown on Table 1.

Their draining property and odor were tested by the methods described below to give a result shown on Table 2. In addition, an amount of retained water per unit area of heat conducting surface in contact with air was also measured. Values obtained by the latter test are given also on Table 2, represented in % of the value for the sample No. 1.

In the test of the draining property, those samples were immersed in water, withdrawn therefrom to stand for 30 minutes and were subsequently weighed for measurement

TABLE 1

| | Sample Nos. | | | | | |
|---|---|---|---|---|---|---|
| | 1 | 2 | 3 | 4 | 5 | 6 |
| Tube's header | both-sided | one-sided | one-sided | both-sided | both-sided | both-sided |
| Dimension (mm) | 227W × 235L × 75T | 245W × 225L × 90T | " | 227W × 235L × 75T | " | " |
| Ef. front area ($m^2$) | 0.046 | 0.048 | " | 0.046 | " | " |
| Heat ex. area con. air ($m^2$) | 3.18 | 4.35 | " | 3.18 | " | " |
| Tube pitch (mm) | 10.8 | 13 | " | 10.8 | " | " |
| Fin pitch (mm) | 2.0 | 1.8 | " | 2.0 | " | " |
| No. of passes | 4 | 3 | " | 4 | " | " |
| Tubes per pass | 5-5-5-5 | 5-6-7 | " | 5-5-5-5 | " | " |
| Recessed ribs | straight | scattered | " | straight | " | " |
| Dim. of str. canal or rib (mm) | 2.1W × 1.8D | 2.0W × 1.0D × 19.5L | " | 2.1W × 1.8D | " | " |
| Pitch of str. canal (mm) | 9.4 | — | — | 9.4 | 9.4 | 9.4 |
| Area ratio of str. canal. | 19.6% | — | — | 19.6% | 19.6% | 19.6% |
| Hydrophl. coating | Invention | Water glass | Prior art | None | Water glass | Prior art |

TABLE 1-continued

| | Sample Nos. | | | | | |
|---|---|---|---|---|---|---|
| | 1 | 2 | 3 | 4 | 5 | 6 |
| Composition* | PVA 45 pbw etc.** | $K_2O/SiO_2$ 35 pbw etc.*** | resin PA 98 pbw etc**** | — | $K_2O/SiO_2$ 35 pbw etc.*** | resin PA 98 pbw etc.**** |
| Contact angle (θ)# | 7–13 | ≦5 | 30–40 | 50 | ≦5 | 30–40 |
| Weight (Kg) | 1.8 | 2.0 | 2.0 | 1.8 | 1.8 | 1.8 |

Notes for Table 1:
ef. = effective, ex. = exchanging, con. = contacting, Dim. = Dimension, str. = straight, W = width, L = length, T = thickness, D = depth, Hydrophl. = Hydrophilic, * = composition of the coating, pbw = parts by weight, # = θ of the coating,
etc.** = 18 pbw of polyamide + 18 pbw of polyvinyl pyrrolidone + 9 pbw of phenolic resin + 1 pbw of nonionic surfactant, +9 pbw of bis(2-pyridylthio)-zinc 1,1'-diphoxide,
etc.*** = 65 pbw of polyamide,
etc.**** = 2 pbw of hardener,
PVA = polyvinyl alcohol resin, PA = polyamide resin.

TABLE 2

| Sample Nos. | Invention 1 | Reference 2 | Reference 3 | Reference 4 | Reference 5 | Reference 6 |
|---|---|---|---|---|---|---|
| Ribs Hydr. coating | straight/ novel resin | scat./ water glass | scat./ prior a. resin | straight/ none | straight/ water glass | straight/ prior a. resin |
| Drainage | ○ | XX | XX | X | ○ | |
| Odor | ○ | XX | X | XX | XX | |
| Amount of retained water (%)* | 100 | 200 | 218 | 124 | 104 | 114 |

Notes:
"scat." = scattered,
"Hydr." = Hydrophilic,
"novel resin" = a hydrophilic resin provided in the invention,
"piror a. resin" = prior art resin, and
* = Amount of retained water per unit area in contact with air.

of the quantity of retained water at that point of time (corresponding to an operation state in actual use). The reference symbols "○", "Δ","X" and "XX" on Table 2 respectively indicate: a little amount of retained water, without a possibility of causing the waterdrop flying; a somewhat greater amount of retained water, but scarcely causing the waterdrop flying; a significant amount of locally retained water, likely to cause the waterdrop flying; and, a remarkable amount of retained water, inevitably causing the waterdrop flying.

Evaluation of the unpleasant odor was done relying on human olfactory sense, but under a condition simulating the actual operation state of the condenser. The reference symbols "○", "Δ", "X" and "XX" respectively indicate: being odorless at the beginning of test and remaining odorless thereafter; not stinking at the beginning, but emitting odor after use for a long time; scarcely stinking at the beginning, but emitting odor before long; and, remarkably stinking from the beginning of use.

As will be seen from the result given above, the evaporator which comprises the tubular elements each having the inwardly protruding and vertically extending recessed ribs and which has its surfaces covered with the specific hydrophilic resin coating according to the present invention, is superior to all the other reference samples of evaporator in respect of not only their odor but also of their draining property. Thus, both the problem of waterdrop flying and the bad smell are eliminated at the same time by the invention.

The data on water retention per unit surface area in contact with air has established a fact that the specific resin coating in the invention does match well the straight drain canals to give the best drainage. Although the resin composition in the invention ( having a contact angle of 20° or less, and 7°–13° in the embodiment ) is not necessarily more hydrophilic than the water glass coating ( being most hydrophilic heretofore, and having a contact angle of 5° or less ), the former is less retentive of water than the latter. This indicates an "organic" and effective combination of the specific resin coating with the straight drain canals.

Figure 13:
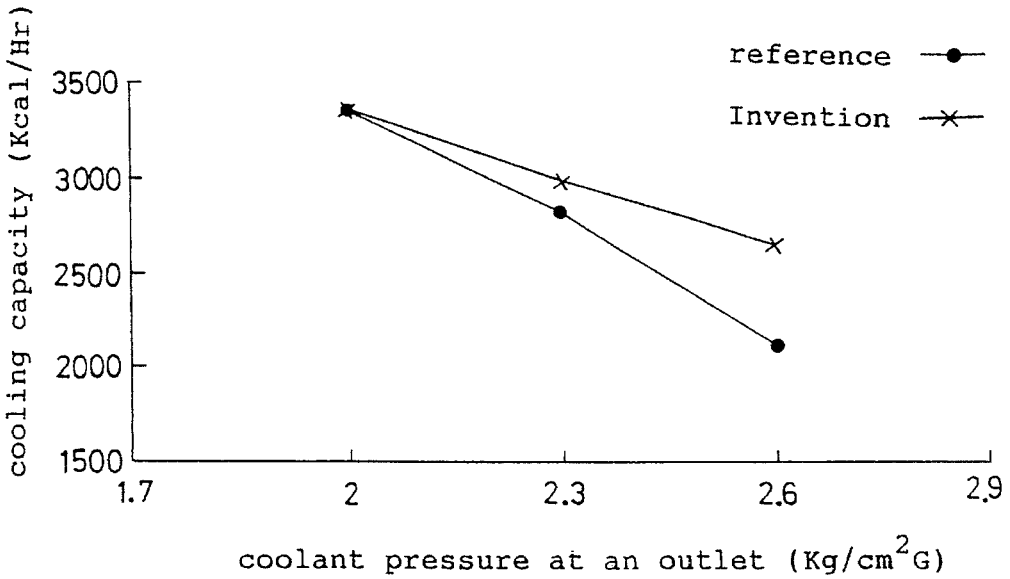
FIG. 13 is a graph showing a relationship between a cooling capacity and a coolant pressure at an outlet.
Figure 14:
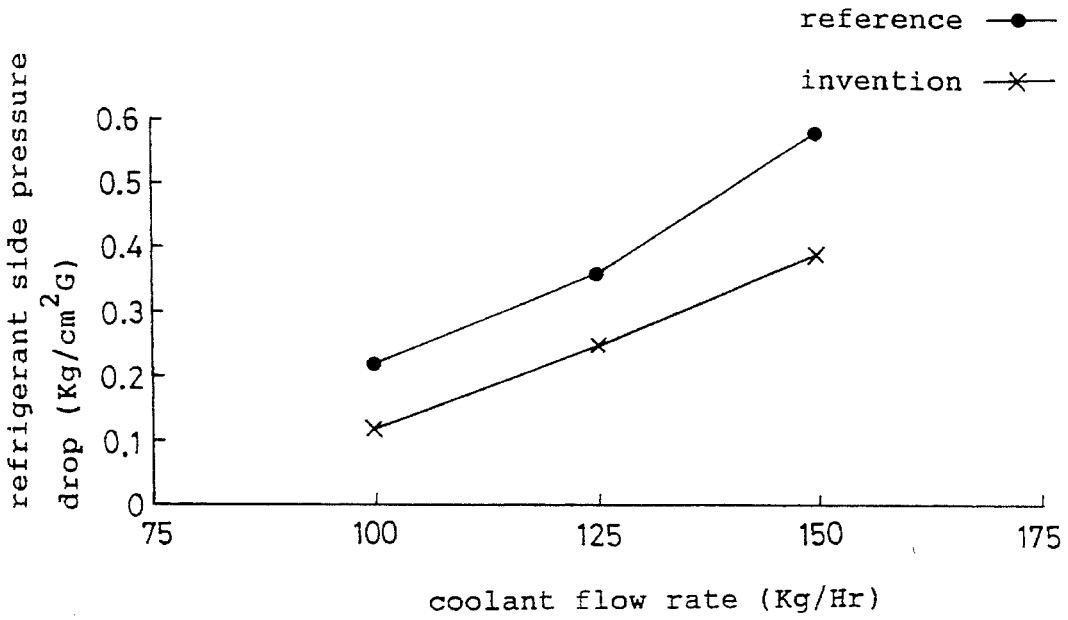
FIG. 14 is a graph showing a relationship between a coolant flow resistance and a coolant flow rate.
Figure 15:
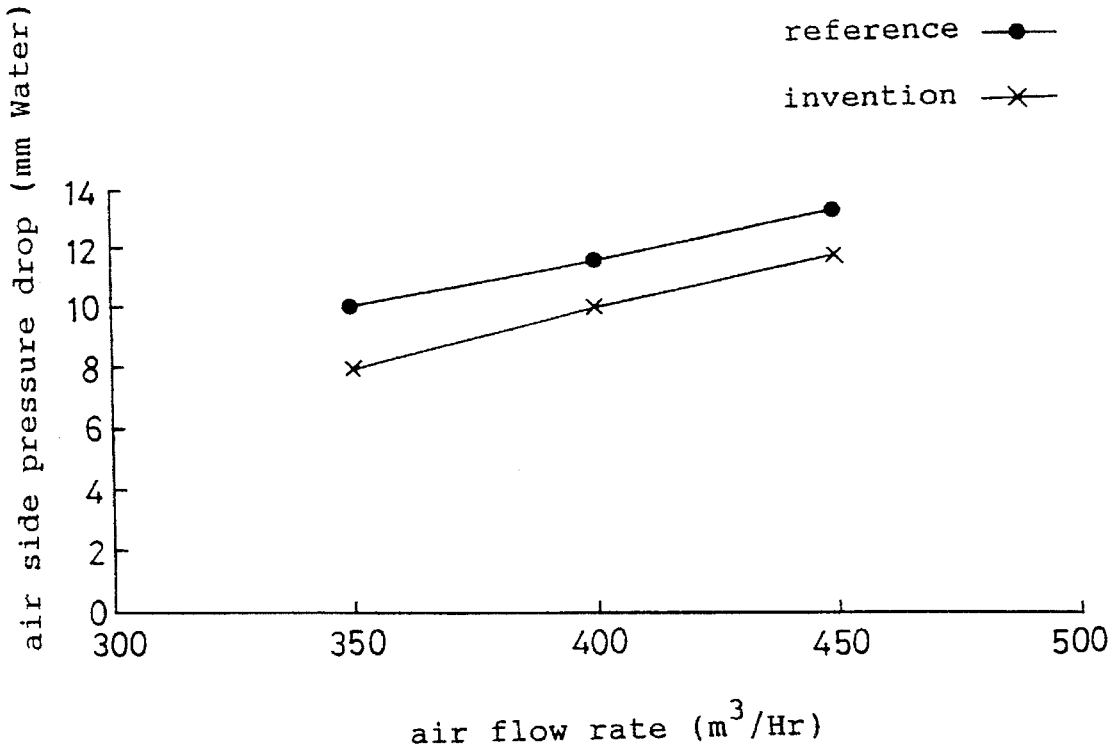
FIG. 15 is a graph showing a relationship between an air flow resistance and an air flow rate.

Further, performance comparison of the sample No. 1 (invention) was made with the reference No. 2 which is the stack type evaporator of the one-sided header structure and is a typical one widely and currently employed in the field. FIGS. 13 to 15 give the result of comparative tests which were executed on: their cooling capacity for varied coolant pressure at outlet; their coolant flow resistance for varied flow rate of coolant; and their air flow resistance for varied air flow rate.

The cooling capacity of the reference No. 2 decreases sharply with increasing coolant pressure at outlet, whereas the capacity of the sample No. 1 ( invention ) decreases gradually. This means that the evaporator provided by the invention is improved in its cooling capacity for the varied outlet coolant pressures. As for the coolant flow resistance, the sample No. 1 proved less resistive to coolant flow than the reference No. 2 by ca. 0.1 $Kg/cm^2$ or more, for varied coolant flow rates. Also, the sample No. 1 proved less resistive to air flow then No.2 by ca. 2 mmAg, for varied air flow rates. These data indicate that the evaporator is excellent also in its cooling capacity and performance.

In summary, the evaporator in the present invention comprises the tubular elements each having the inlet header portion at its one end and the outlet header portion at its other end. Each tubular element is composed of the pair of core plates, and each of them comprises the recessed ribs protruding inwardly thereof and vertically extending in parallel with one another between the header portions. Thus, the unit flow paths are formed for coolant which flows through the tubular element in such a manner that any offset flow or turbulent flow takes place therein.

Consequently, heat exchange is carried out evenly and effectively throughout the evaporator, thereby improving its heat exchanging capacity as a whole and also reducing the loss in coolant pressure.

Further, the ribs protruding from one core plate alternate with the other ribs of the other core plate in each couple of the core plates. The inner end surfaces of those ribs from one core plate do face and are tightly adjoined to the flat portions of the other one. This feature is advantageous in that any slight mis-alignment between the facing core plates can never result in an imperfect adjoining of said plates, though it has been inevitable for the prior art evaporators in which the ribs are directly adjoined together. Due to such a feature, the assembling work can be done more roughly, without failing to manufacture strong tubular elements each comprising a pair of rigidly adjoined core plates. Moreover, such a structure provides a larger area for the heat transferring coolant, and thus raising the heat exchange efficiency of the evaporator.

It is a more important feature that the outer recesses of the recessed ribs inwardly protruding and vertically extending parallel between the upper and lower header portions of each tubular element do function as the straight drainage grooves or canals for discharging the condensed water. The water condensed on the surfaces of the tubular elements and fin members smoothly flows downwards along the ribs through the straight canals and is quickly removed from the evaporator.

The unique combination of such straight drain canals ( i.e., one feature ) with the specific hydrophilic resin coating ( i.e., the other feature ) covering the surfaces of tubular elements and fin members produces in the invention an unexpected synergism of these features. The synthesized effect is greater than the simple sum of the individual effects resulting from the features, so that the drainage or water-repelling property of the evaporator is improved in a surprising manner.

As a result, the waterdrop flying is avoided to an almost perfect degree and consequently the adherent condensed water is prevented at the same time from allowing the mildew or mold to grow therein, thus keeping pleasant the air-conditioned environment in the automobile cabin or room.

The resin composition in the invention comprises polyvinyl alcohol as the main component as well as the hydrophilic agent ( i.e., polyamide and/or polyvinyl pyrrolidone resins ) blended therewith. This composition does not emit such a stinking odor as is the case for the water glass coating, also contributing to the better environment in the automobile cabin.

In a preferable case as defined in the claims 2 and 3 wherein the film hardener, surfactant and microbicide are blended with the main component and hydrophilic agent just mentioned above, the "antimold" effect becomes much higher while ensuring the good drainage through the straight canals.

In another preferable case as set forth in the claim 4, wherein the hydrophilic resin coating has the contact angle θ of 5° to 20° between it and the waterdrop, drainage effect of the straight drain canals will be doubled so that the stack type evaporator becomes free from the waterdrop flying and from the bad smell so as to be advantageously employed in the air conditioner.

What is claimed is:

1. In a stack type evaporator comprising:

a plurality of tubular elements each composed of a pair of facing core plates which are adjoined one to another at their peripheries so as to define a coolant path therebetween;

a plurality of fins each interposed between the two adjacent tubular elements which are stacked side by side in a direction of their thickness;

upper and lower header portions respectively formed at upper and lower ends of each tubular element, with the header portions being connected to the other corresponding header portions so as to unite the tubular elements to form the evaporator;

a plurality of recessed ribs protruding inwardly from each core plate and extending vertically in parallel with one another from the upper header portion towards the lower header portion, wherein an inner end of each rib of one core plate faces and is bonded to a flat portion between the ribs of the other core plate;

the coolant path being formed through each tubular element and divided by the ribs into a plurality of discrete unit paths extending from the upper header portion towards the lower header portion;

each tubular element having on its outer surfaces a plurality of straight drainage canals for condensed water which are formed to extend from the upper header portion towards the lower header portion; the improvement comprises:

a non-water glass hydrophilic resin coating covering the outer surface of the tubular elements and the fins; and the hydrophilic resin coating having a contact angle θ falling within a range of 5°–20° whereby both water drop flying and bad smell emission are reduced, the hydrophilic resin coating being applied by immersing said outer surfaces in a solution containing a polyvinyl alcohol resin as its main component, polyamide and/or polyvinyl pyrrolidone resins as its hydrophilic agent blended with the main component, a film hardener having a concentration sufficient to produce a hardened coating but not so great as to react with hydrophilic atom groups in the hydrophilic resin molecules and thereby fail to enhance the hydrophilic property, and a surfactant to stabilize said resin solution so that it will not become bubbly;

a width "W" of each straight drainage canal covered with the hydrophilic resin coating being included in a range of from about 0.5 to about 3 mm, the width being defined as a distance between surfaces of the resin coating covering an open mouth for the canal; and a surface area ratio falling within a range of from about 5 to about 40%, the surface area ratio being a ratio of a total area of the open mouths to an overall surface area of each core plate, and the overall surface not including expanded end regions of the core plate but inclusive of flat portions and the straight canals thereof, whereby the combination of said plurality of straight drainage canals and said coating in said stack type evaporator results in substantially lower odor and retained water as compared to a coated scattered rib evaporator.

2. A stack type evaporator as defined in claim 1, wherein the contact angle θ is from 7° to 13°.

3. A stack type evaporator as defined in claim 1, wherein thickness of the hydrophilic resin coating is 0.2–1.5 μm.

4. A stack type evaporator as defined in claim 1, wherein thickness of the hydrophilic resin coating is 0.5–1.3 μm.

5. A stack type evaporator as defined in claim 1, wherein each of the plurality of straight drainage canals for condensed water has a width "W" of 1–3 mm, and a depth "D" of 1–2.5 mm, and are arranged at a pitch "P" of 7–14 mm.

6. A stack type evaporator as defined in claim 1, wherein each of the plurality of straight drainage canals for condensed water has a width "W" of 1.3–2.4 mm, and a depth "D" of 1.5–2.1 mm, and are arranged at a pitch "P" of 8–11 mm.

7. A stack type evaporator as defined in claim 1, 5, or 6, wherein a ratio of the surface area of the open mouths of the drainage canals for condensed water to the overall surface area of each core plate except for its upper and lower expanded portions is from 15–25%.

8. A stack type evaporator as defined in claim 1, wherein the fins are corrugated fins.

9. A stack type evaporator as defined in claim 8, further comprising side plates each disposed outside the corrugated fin which is secured to the outermost core plate, wherein each side plate comprises a plurality of parallel groove-like recesses extending vertically along an inner surface of the side plate, whereby the recesses provide vertical drainage canals between the side plate and the corrugated fin.

10. A stack evaporator as defined in claim 9, wherein the tubular elements, the fins and the side plates are all formed of aluminum or alloys of aluminum.

11. A stack type evaporator as defined in claim 1, wherein the core plates constituting each tubular element are each made by pressing a brazing sheet which comprises a core sheet having both surfaces clad with a brazing agent layer.

* * * * *